US005142111A

United States Patent [19]

Blanchard et al.

[11] Patent Number: 5,142,111

[45] Date of Patent: Aug. 25, 1992

[54] CIRCUIT BREAKER WITH CURRENT LOOPS ASSISTING DEVELOPMENT OF THE ARC

[75] Inventors: Christian Blanchard, Rueil Malmaison; Michel Lauraire, Courbevoie; Didier Vigouroux, Jouy Le Moutier, all of France

[73] Assignee: Telemecanique, France

[21] Appl. No.: 584,825

[22] Filed: Sep. 19, 1990

[30] Foreign Application Priority Data

Sep. 19, 1989 [FR] France ..... 89 12286

[51] Int. Cl.[5] ..... H01H 33/18

[52] U.S. Cl. ..... 200/147 R; 200/144 R

[58] Field of Search ..... 200/144 R, 147 R, 147 A, 200/147 B, 144 C

[56] References Cited

U.S. PATENT DOCUMENTS

| | | | |
|---|---|---|---|
| 2,555,799 | 6/1951 | Lerstrup | 200/147 R |
| 3,483,343 | 12/1969 | Heft | 200/147 R |
| 4,112,275 | 9/1978 | Kohler | 200/147 R |
| 4,237,355 | 12/1980 | Fechant et al. | 200/147 R |
| 4,387,281 | 6/1983 | Haury et al. | 200/147 R |
| 4,491,705 | 1/1985 | Hayashi et al. | 200/147 R |
| 4,511,774 | 4/1985 | Forsell | 200/147 R |
| 4,516,005 | 5/1985 | Gallatin et al. | 200/147 R |
| 4,652,707 | 3/1987 | Mori et al. | 200/144 R |
| 4,810,841 | 3/1989 | Wolf | 200/147 R |
| 4,975,553 | 12/1990 | Oster | 200/147 R |

*Primary Examiner*—J. R. Scott

*Attorney, Agent, or Firm*—William A. Drucker

[57] ABSTRACT

Circuit breaker including a spark extinction structure comprising a conducting system, having one or two current loops extending on each side of a plane of symmetry passing through an arc deflector and a fixed contact of the circuit breaker. The conducting system is obtained by plastic deformation and bending of a flat piece stamped out from a sheet of conducting material so that the wasted material is very much reduced.

4 Claims, 5 Drawing Sheets

CIRCUIT BREAKER WITH CURRENT LOOPS ASSISTING DEVELOPMENT OF THE ARC

BACKGROUND OF THE INVENTION

The invention relates to a circuit breaker for breaking a circuit subject to a short circuit current, in which the natural development of the arc which appears on opening of a pair of contacts placed in a chamber, and moves along a deflecting conductor is assisted and accelerated by a magnetic field which is created by at least one loop conducting the short circuit current. The loop is placed outside the chamber in a plane substantially parallel to that which passes through the deflector and through these contacts.

It relates more particularly to a circuit breaker of a type similar to that described in patent specifications EP 231 600, in which the conducting loop comprises:

- a first end portion adapted to be electrically connected to the fixed contact;
- a tongue extending the first portion so as to form the deflecting conductor; and
- a second end portion, placed in the alignment of the tongue and joined directly or indirectly to a connection terminal of the apparatus which is fitted with the circuit breaker.

In circuit breakers of the above type, arc extinction is promoted by means of a magnetic field which is established in the current path for accelerating swelling and hastening destabilization of the arc. It is thus possible to manufacture current limiter apparatuses of reduced size.

The construction of current loops is a relatively costly operation to the extent that it requires either the assembly of several elements or the stamping out and bending of stamped conducting pieces, whose development in the plane of the metal sheet from which they are taken badly uses the available area; such a stamping technique is however advantageous because it simplifies the mounting of apparatus manufactured on a very large scale, by avoiding subsequent welding and/or assembly operations.

It is an object of the invention to provide a circuit breaker such as defined above, in which the shaping of the current loop will meet the following requirements: simplicity, ease of assembly, reduced width and reduced manufacturing cost.

SUMMARY OF THE INVENTION

In accordance with one aspect of the invention the loop is formed by bending a longitudinal portion of a single flat blank stamped out from a metal strip, this longitudinal portion being drawn out and bent in its own plane.

It is another object of the invention to provide an efficient loop, the length of which will correspond to predetermined criteria, while avoiding exerting on the material used excessive deformation stresses.

Other objects of the invention consist in particular arrangements of the loop for obtaining advantageous current limitation characteristics by increasing the efficiency of the loop.

DESCRIPTION OF THE PREFERRED EMBODIMENTS

Figure 1:
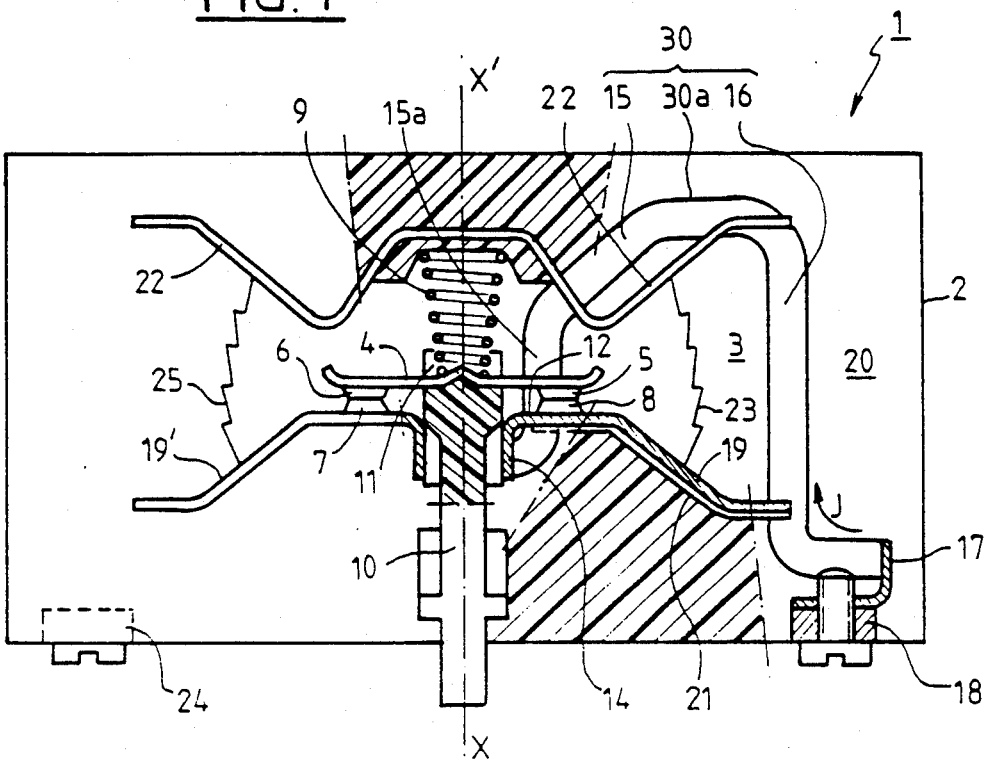
FIG. 1 is an elevational view of a circuit breaker according to a preferred embodiment of the invention, in section through a mean plane passing through the axis of movement of a movable switching member, and through an associated terminal.
Figure 2:
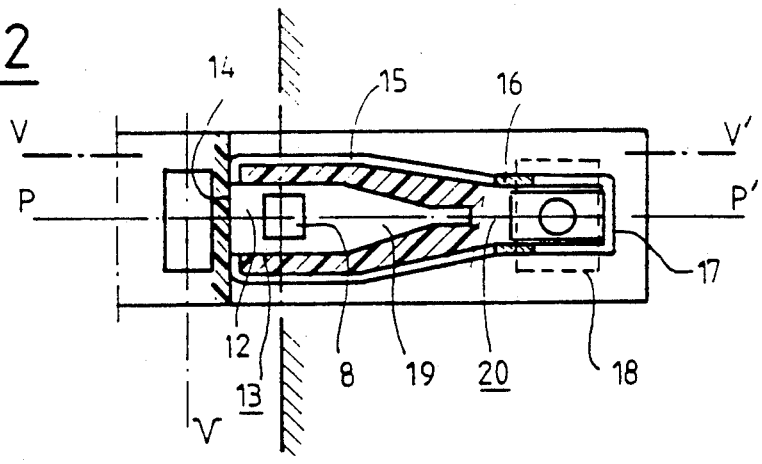
FIG. 2 is a top view of the circuit breaker of FIG. 1.

The switch device 1 (FIG. 1), is housed in a prismatic insulating case 2 inside which are located one (or two) cut-off chambers 3, containing a movable contact bridge 4 having an axis of movement XX'.

The whole device is symmetrical with respect to axis XX'. Contact bridge 4 has contact studs 5, 6 cooperating with fixed contact studs 7, 8 and is subjected to the action of a contact pressure spring 9 which is compressed or released by the movement of an external pusher 10 acting on a means 11 guiding the contact bridge and holding it laterally in position.

The fixed contact 8 is brazed on an end portion 12 of a copper conducting piece 13 having a bent portion 14, a rising leg $\mathbf{15}_a$, 15, a descending leg 16 and a second end portion 17 which is bent outwards to receive a connection terminal 18; an extension 19 of portion 12 forming a deflector extends in the chamber in the direction of the terminal and joins a region 20 opposite the contacts in which means may be situated for de-stabilizing the electric arc, such as a narrow slit, splitting fins, etc. . . .

Advantageously, a flat magnetizable piece 21 is disposed under deflector 19.

A second conducting deflection piece 22, which also extends in a symmetrical chamber not shown, allows the current of an arc 23 to flow between terminal 18 and an opposite symmetrical terminal 24 while supplying a second arc 25 symmetrical with the first arc whose path passes through a symmetrical deflector 19'.

When a current J flows from terminal 18 to terminal 24 through conductors 17, 16, 15, 14, 12, 19, arc 23, the second deflector 22 and the corresponding symmetrical elements, the different segments 14, 15, 16, 17 form a conducting loop 30 capable of creating, in the zone through which the arc passes between the fixed contact and region 20, a magnetic field having a direction perpendicular to the figure.

The interaction of this field and of current J passing through arc 23 imparts to the arc electromagnetic forces which cause a movement towards the right of the Figure faster than natural swelling would, as well as an extension of its column due to the divergent paths of the deflectors; as for arc 23, it is moved rightward.

Such deformations and movements of the arc develop therein a high voltage which is necessary for obtaining rapid decrease of the short-circuit currents such as J.

Figure 3:
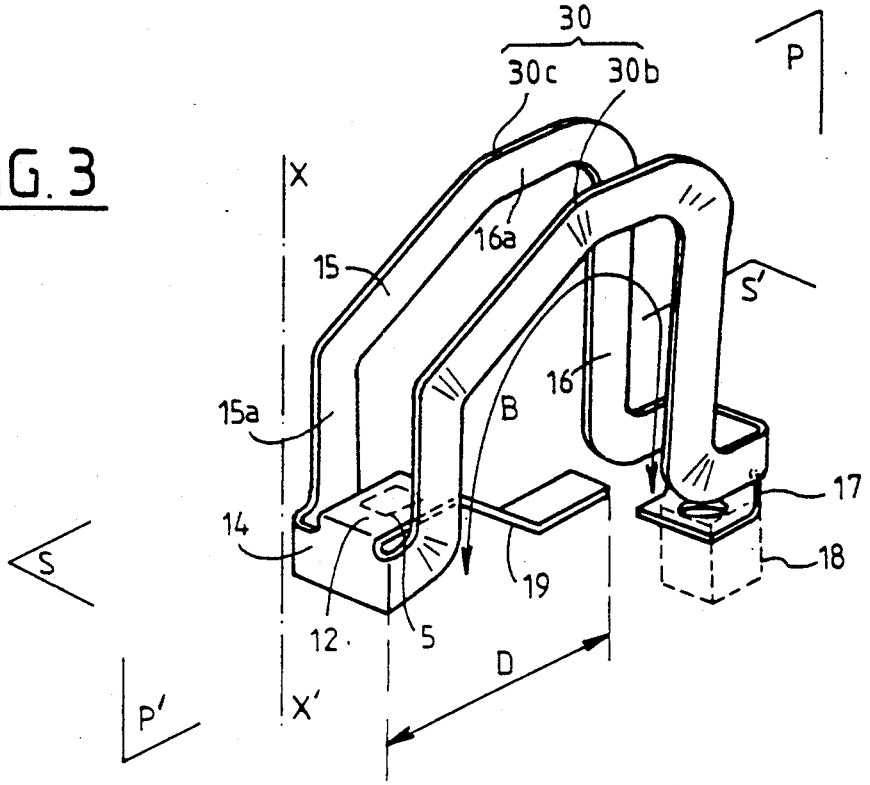
FIG. 3 is a perspective view of a magnetic arc extinction assistance mechanism comprising two current loops.

As can be seen in FIG. 3, between the terminal and the first deflector, two loops $30_c$, $30_b$ may be connected parallel to the median plane PP' of the switch device passing through the axis XX', contact piece 5 and terminal 18.

Figure 4:
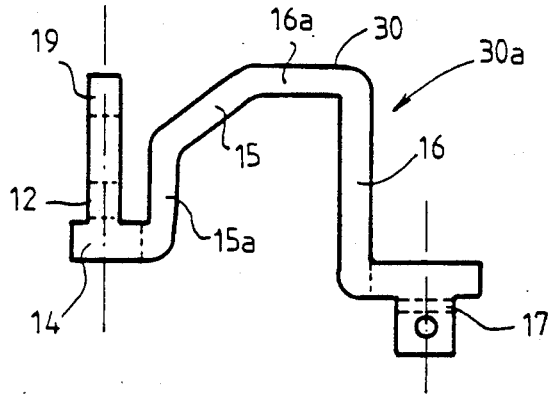
FIG. 4 is a view of a blank which would have to be used if only bending were used to obtain an assistance mechanism having only one current loop.

As can be seen in FIG. 4, the development in a plane of a stamped and bent conducting piece $30_a$ comprising only a single current loop such as 30, would lead to a very poor use of a metal strip. A similar situation would naturally occur if such a piece comprised two current loops $30_c$, $30_b$, see FIG. 5, whose development, in the plane of a metal strip, could only take place by including a separation -S-T, for example at the level of half portions $17_a$, $17_b$.

Figure 6:
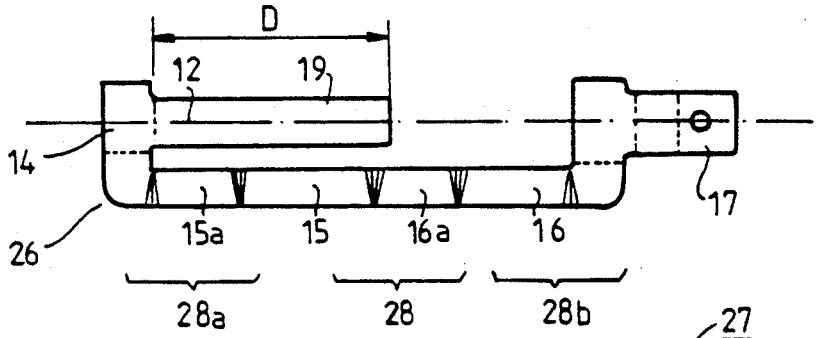
FIGS. 6 and 7 are views of blanks used in accordance with the invention.

A rough metal stamped blank 26 having a longitudinal portion 28, $28_a$, $28_b$, as shown in FIG. 6, may advantageously be used for forming a conducting piece having a single loop as shown in FIG. 4, when it is subjected to deformations in its plane for causing the different elements 19, 12, 14, 17; 15, $15_a$, 16, $16_a$ to appear at the appropriate positions.

Such deformations comprise local bends and/or extension of the metal in the plane, as well as bends which must appear in the angles, as is shown in the hatched, respectively dotted zones in FIG. 6. One can appreciate from FIGS. 4 and 6 that the saving of material thus achieved.

Figure 5:
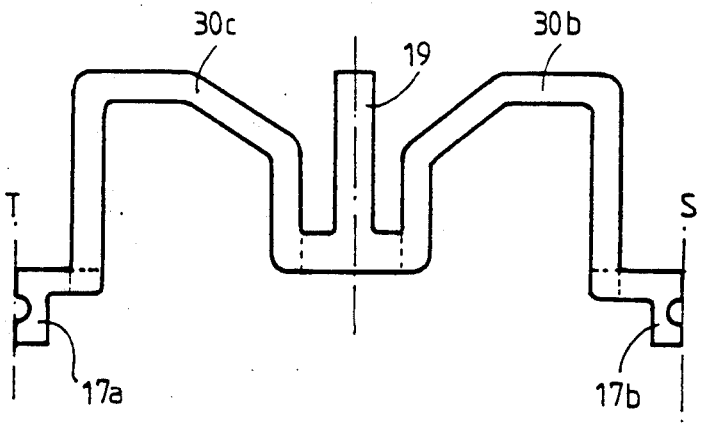
FIG. 5 is a view of a blank which would have to be used if only bending were used for obtaining an assistance mechanism with two current loops.
Figure 7:
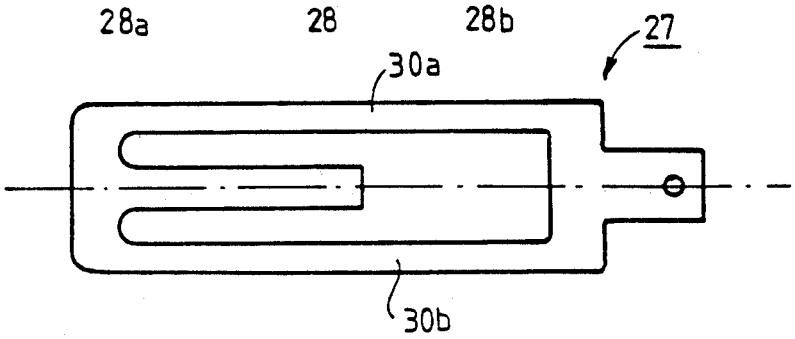

A blank 27, FIG. 7, will be used when it is to comprise two loops $30_c$, $30_b$, as shown in FIG. 3, where it can be seen that the separations -S- and T, which are necessary when a blank as shown in FIG. 5 is used, may be omitted. In this case, the loops 30 are formed by bending the margins (not projecting) of the blank for example at right angles towards a plane parallel to the plane PP', then drawing/bending these margins in the bending plane.

The conducting piece which has been illustrated shows, see FIG. 1, the fact that the rising leg(s) $15_a$ are connected to portion 12 by a portion 14 placed at a level lower than that of plane SS' where the fixed contact stud 8 is fixed. This leg 15 is further positioned so that the pair of contacts 5, 8 is situated between legs $15_a$ and 16. These measures, which locally improve the distribution of the magnetic field for promoting the initial movement of the arc, are particularly easy to use with a loop formed by the preceding operations.

Figure 8:
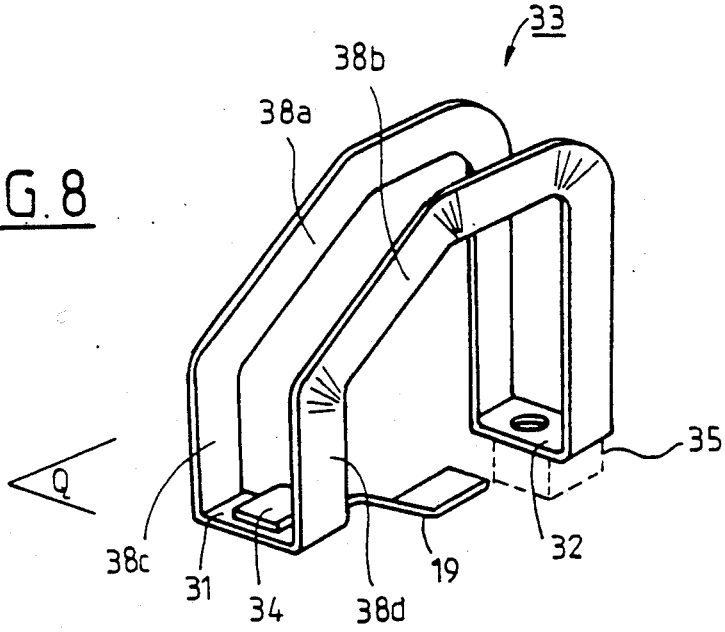
FIG. 8 is a perspective view of another embodiment of a magnetic assistance mechanism with two current loops.
Figure 9:
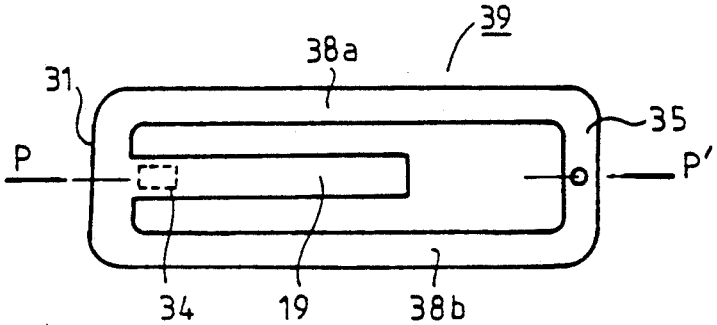
FIG. 9 is a view of the blank corresponding to the mechanism shown in FIG. 8.

The invention may however be applied for example to a piece 33 having two loops $38_a$, $38_b$, illustrated in FIG. 8 where neither the front bent back portion 14 nor the front portion 17 appear and where two cross-pieces 31, 32 are respectively provided for supporting the fixed contact 34 and being associated respectively with terminal 35; a corresponding blank 39 is shown in FIG. 9. It can be seen that, contrary to the preceding embodiment, the roots of the rising legs $38_c$, $38_d$ originate in plane Q containing the contact piece 34.

In the switch apparatus which has been described, the arc moves while keeping its feet on two opposite deflectors 19, 19' which may be positioned on each side of a double cut-off contact bridge 4.

For single and double cut-off switch devices intended for apparatus having nominal ratings of 16A to 63A, a ratio K may be defined of about 1.5 to 4 between the developed length -B- of the loop (for example portions $15_a$, 15 and $16_a$, 16 of FIG. 3) and the distance -D- measuring the length of the deflector (19).

These values, which are advantageous in obtaining loops with good efficiency in assisting development of the arc, without exposing the metal, for instance copper, to excessive stresses, are not of course limitative, taking into account the particular applications which might be envisaged and the thickness which the strip might have from which the blanks are taken.

It is moreover clear that portions 17 or 32, which have been up to now directly associated with terminals 18 or 35, could be indirectly connected by means of extension conductors if the terminals were further away from each other in a particular apparatus.

Considering the fact that the conducting piece with its loop or loops and its contact and terminal regions represents an indissociable whole, it is not possible to incorporate it directly in a case of any shape since one part will be situated inside and another part outside.

Figure 10:
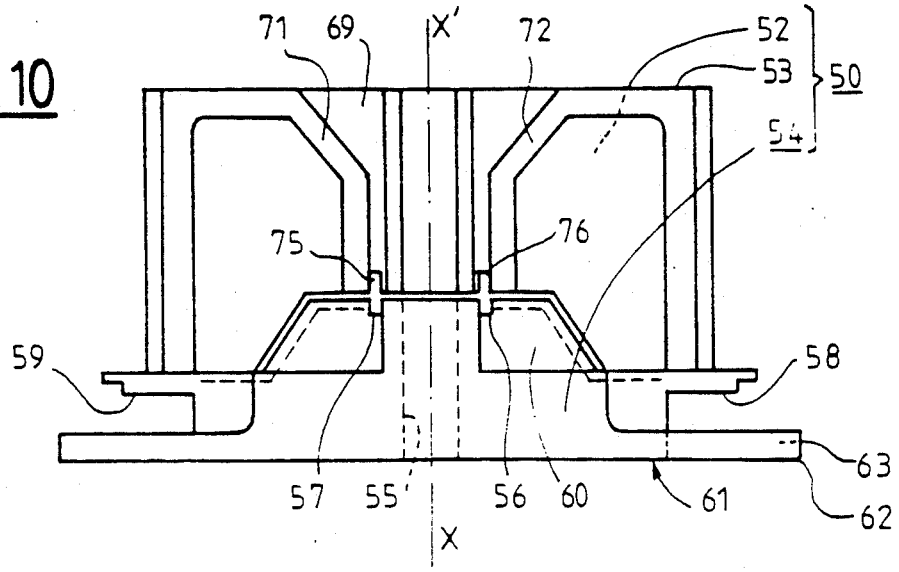
FIG. 10 is an elevational view of an insulating case housing the conducting piece forming the two loops.
Figure 11:
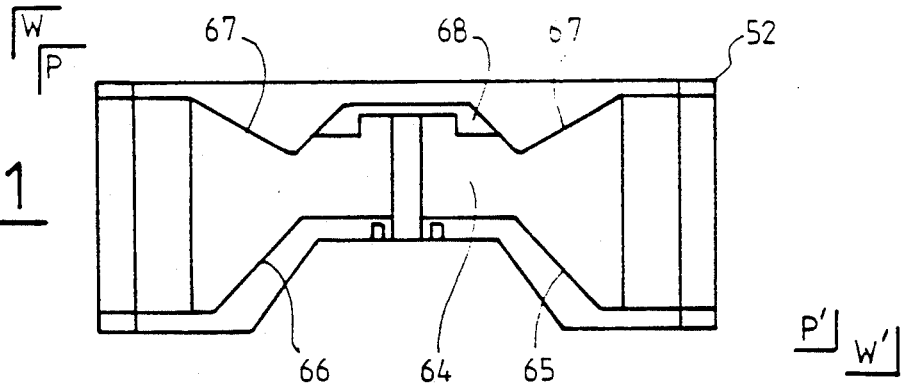
FIG. 11 is an elevational view of an internal face of one of the shells of the case.
Figure 12:
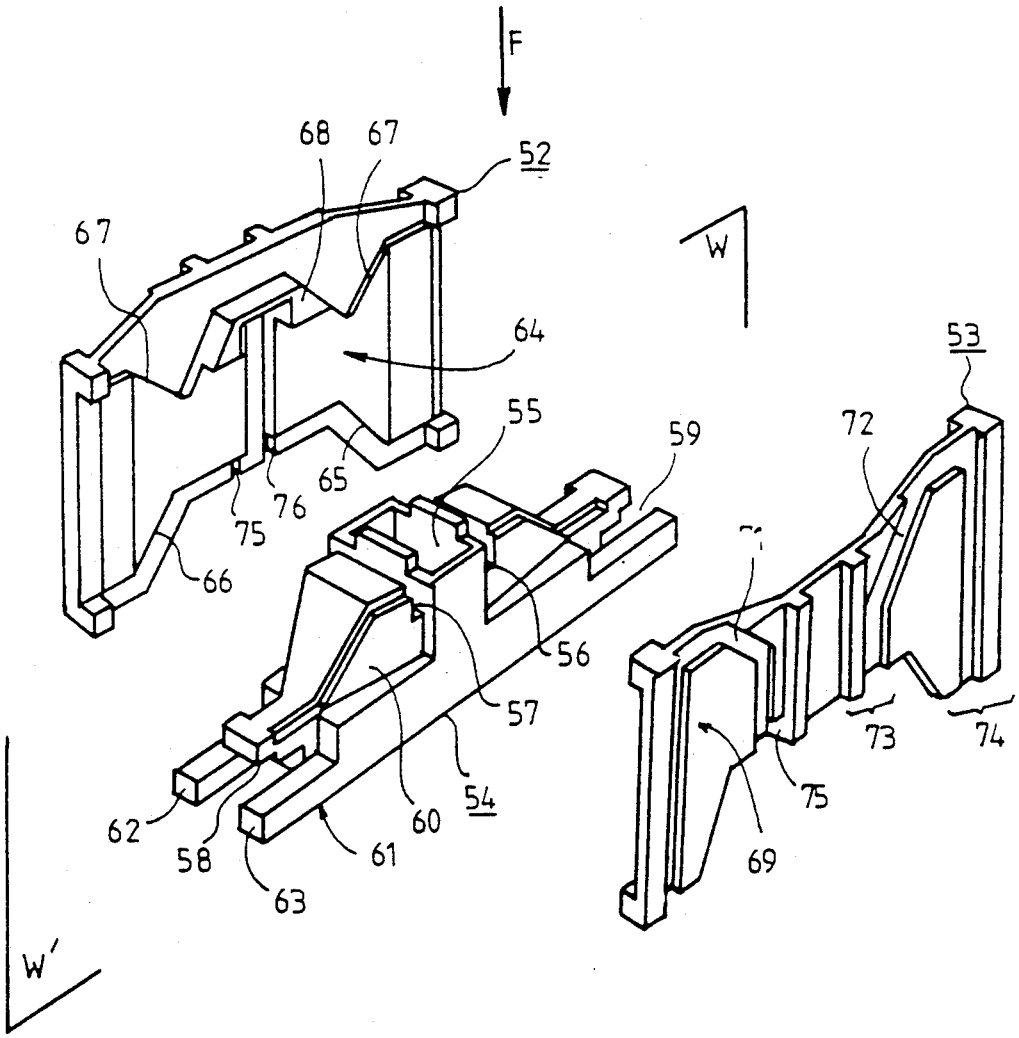
FIG. 12 is an exploded perspective view of the two shells and of the base forming the insulating case.

Within the scope of the invention, which relates to a switch apparatus, see FIGS. 10 to 12, it is then necessary to define a case 50 capable of housing the assistance conducting piece, in particular when it has two loops. FIGS. 10, 11, 12, illustrate a case with two symmetrical cut-off chambers, comprising two insulating shells 52, 53 which are substantially symmetrical with respect to a median joint plane WW' where the median plane PP' of the conducting piece will be situated after fitting and a base 54 intended mainly to locally close the cavity included between the two shells so as to form the two symmetrical cut-off chambers of a switch having a contact bridge.

This base comprises mainly an axial guide channel 55 for receiving a mobile contact bridge support as at 10 in FIG. 1 and a number of recesses 56, 57 and 58, 59 for receiving the end portions 14 and 17 for immobilizing them.

This first positioning of the conducting piece may here take place by using, if required, its resilience parallel to plane PP'. The recesses, 58, 59, which are formed in a central rib 60 of the base having a width less than that of the external face 61, extend as far as this face while leaving on each side of the median plane two parallel arms 62, 63 contributing to holding a terminal such as 18 in position.

Shells 52, 53 each have on an internal wall of the chamber 64, on the one hand, recesses or grooves 65, 66 and 67 for firmly fixing the opposite edges of individual deflectors 19 and those of the common deflector 22 and, on the other hand, a boss such as 68 for receiving the end of the spring 9 returning the contact bridge 4.

On an external wall 69 opposite wall 64 of a shell are provided open passages or shallow imprints 71, 72 which are shaped for receiving the external portions of the loops $30_c$, $30_b$ and which extend consequently between a region 73 close to portion 14 and a region 74 close to portion 17 of the conducting piece. Lateral recesses 75 and 76, which are situated opposite the recesses 56, 57, allow the passage of the ends of the external rising legs of the loops, as far as the internal volume of the cavity present between the shells.

The shells are positioned simultaneously in the direction F by moving the loops $30_a$, $30_b$ of the conducting piece apart and then inserting them in passages 71, 72; the latter, which do not have a depth very much greater than the thickness of the current loops, may simultaneously hold or contribute to holding the different elements forming the case in position.

What is claimed is:

1. A circuit breaker comprising at least a movable contact and a fixed contact placed in a cut-off chamber formed in an insulating case, means for opening and closing the contacts by displacing the movable contact in a predetermined direction for making and breaking an electric circuit having first and second terminals located outside the chamber, an arc deflecting conductor located in a plane passing through the movable and fixed contacts, said deflecting conductor extending into said chamber so that one of the feet of the arc appearing on opening of the circuit may move in said chamber, at least one current loop having portions placed outside the chamber and having a first end portion connected electrically to the fixed contact; a tongue extending from the first end portion and forming the deflecting conductor; a second end portion which is placed in the alignment of the tongue and which is electrically connected to said first terminal; and an intermediate portion connecting the first and second end portions together, wherein the loop is formed by bending an elongate portion of a single flat blank stamped out from a metal strip;

the elongate portion is drawn and bent in its own plane.

2. A circuit breaker as claimed in claim 1, further comprising a further current loop extending between said first and second end portions, said current loop and said further loop being symmetrically located on the respective sides of a mean plane passing through the fixed and movable contacts and the deflector.

3. A circuit breaker as claimed in claim 1, wherein said intermediate portion has a rising leg and a root which extend from the first end portion in a direction substantially parallel to said predetermined direction, said root being substantially located in a half plane containing neither the contacts nor the deflecting conductor.

4. A circuit breaker as claimed in claim 3, wherein said root is attached to the first end portion by a bent lug placed on the side opposite said fixed contact with respect to the movable contact.

* * * * *